US007347519B2

(12) United States Patent
Nagamura et al.

(10) Patent No.: US 7,347,519 B2
(45) Date of Patent: Mar. 25, 2008

(54) PRINTING APPARATUS, CONTROLLING METHOD AND COMPUTER PROGRAM

(75) Inventors: Mitsutoshi Nagamura, Tokyo (JP); Daigoro Kanematsu, Yokohama (JP); Naoko Baba, Kawasaki (JP); Kazuo Suzuki, Yokohama (JP); Tomomi Furuichi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 372 days.

(21) Appl. No.: 11/132,191

(22) Filed: May 19, 2005

(65) Prior Publication Data

US 2005/0264593 A1 Dec. 1, 2005

(30) Foreign Application Priority Data

May 26, 2004 (JP) ..... 2004-156793

(51) Int. Cl.
*B41J 29/38* (2006.01)

(52) U.S. Cl. ..... 347/14; 347/19; 347/41

(58) Field of Classification Search ..... 347/19, 347/41

See application file for complete search history.

(56) References Cited

U.S. PATENT DOCUMENTS 4,653,940 A * 3/1987 Katsukawa ..... 400/124.03
5,889,537 A * 3/1999 Shimada ..... 347/41
6,155,663 A 12/2000 Takayanagi
6,193,358 B1 * 2/2001 Fujita et al. ..... 347/41
6,652,066 B2 * 11/2003 Teshigawara et al. ..... 347/41
6,837,559 B2 * 1/2005 Nunokawa ..... 347/5
7,032,989 B2 * 4/2006 Nishikawa ..... 347/19

FOREIGN PATENT DOCUMENTS

JP 55-119784 9/1980
JP 3376118 11/2002

* cited by examiner

*Primary Examiner*—Lamson Nguyen
*Assistant Examiner*—Justin Seo
(74) *Attorney, Agent, or Firm*—Fitzpatrick, Cella, Harper & Scinto

(57) ABSTRACT

A printing apparatus is provided which can utilize a power supply to its maximum capacity without overly degrading throughput. A print area that can be printed in one scan of a print head is divided into a plurality of blocks. The number of data indicating print in each block is detected. Then the detected value is compared with a plurality of thresholds. Based on a result of the comparison, a scan speed of the print head and the number of scans are determined. This arrangement allows for a selection of an optimum printing method from among a plurality of scan speeds and a plurality of divided printing modes even when an image that may cause a CURRENT in excess of the maximum power supply capacity to flow is printed. With this printing apparatus it is possible to execute printing fully utilizing the power supply capacity without overly degrading throughput.

10 Claims, 14 Drawing Sheets

| | PRINTING METHOD 1 | PRINTING METHOD 2 | PRINTING METHOD 3 |
|---|---|---|---|
| PRINTING SCAN SPEED | CS1 | CS2 | CS2 |
| DIVIDED PRINTING | – | – | 2-DIVIDED PRINTING |

| MEDIA | QUALITY | 1ST THRESHOLD | 2ND THRESHOLD | 3RD THRESHOLD |
|---|---|---|---|---|
| MEDIA A | STANDARD | Stha1 | Stha2 | Stha3 |
| | FINE | Sthb1 | Sthb2 | |
| MEDIA B | STANDARD | Sthc1 | Sthc2 | |
| | FINE | Sthd1 | | |

FIG.9

| MEDIA | QUALITY | PRINTING METHOD | PRINTING METHOD 1 | PRINTING METHOD 2 | PRINTING METHOD 3 | PRINTING METHOD 4 |
|---|---|---|---|---|---|---|
| MEDIA A | STANDARD | PRINTING SCAN SPEED | CS1 | CS2 | CS2 | CS2 |
| | | DIVIDED PRINTING | – | – | 2-DIVIDED PRINTING | 4-DIVIDED PRINTING |
| | FINE | PRINTING SCAN SPEED | CS1 | CS2 | CS2 | |
| | | DIVIDED PRINTING | – | – | 2-DIVIDED PRINTING | |
| MEDIA B | STANDARD | PRINTING SCAN SPEED | CS3 | CS4 | CS5 | |
| | | DIVIDED PRINTING | – | – | – | |
| | FINE | PRINTING SCAN SPEED | CS3 | CS4 | | |
| | | DIVIDED PRINTING | – | – | | |

FIG.10

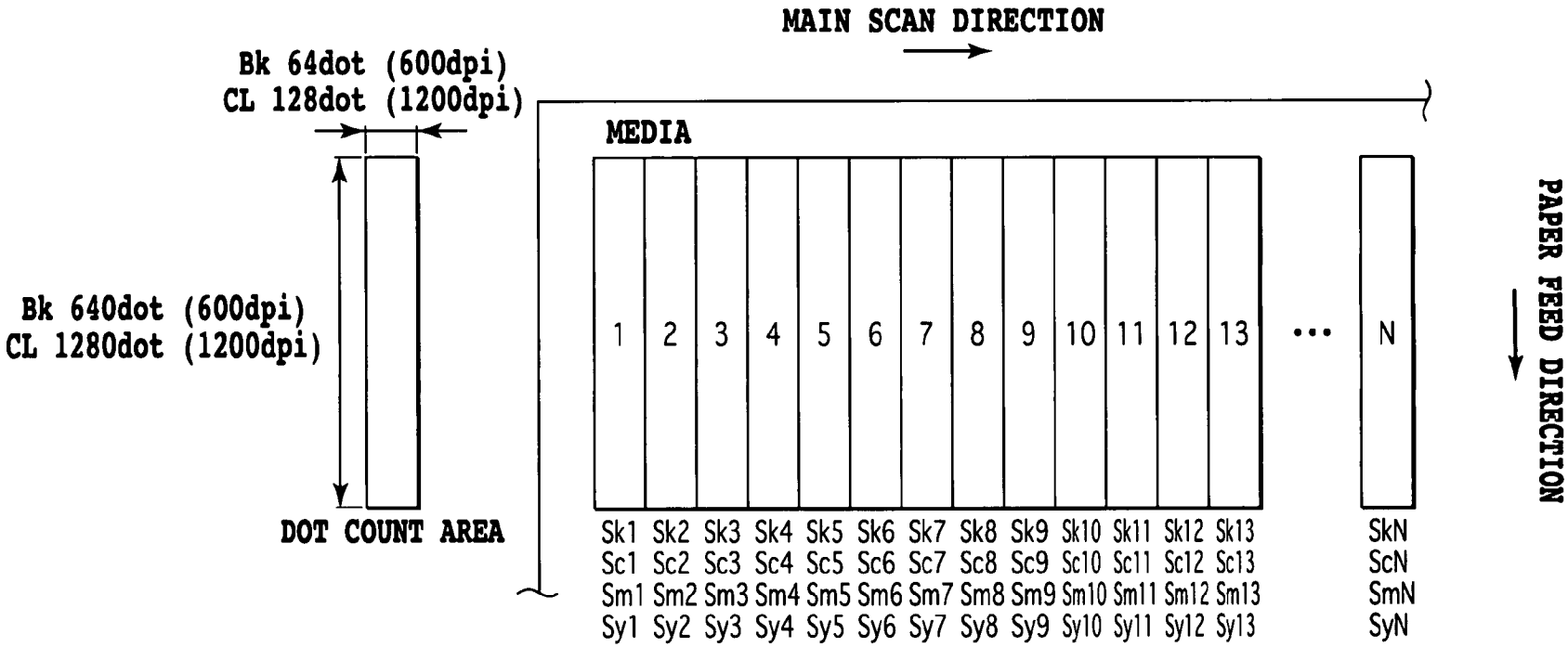

FIG.12

Sk1~SkN : TOTAL OF BLACK DATA INDICATING PRINT IN EACH DOT COUNT BLOCK
Sc1~ScN : TOTAL OF CYAN DATA INDICATING PRINT IN EACH DOT COUNT BLOCK
Sm1~SmN : TOTAL OF MAGENTA DATA INDICATING PRINT IN EACH DOT COUNT BLOCK
Sy1~SyN : TOTAL OF YELLOW DATA INDICATING PRINT IN EACH DOT COUNT BLOCK
S1~SN : TOTAL OF PRINTING ELEMENT OPERATIONS IN EACH DOT COUNT BLOCK WITH COLOR TAKEN AS REFERENCE $Sn = \alpha Skn + Scn + Smn + Syn \ ( n = 0, 1, 2 \cdots N )$

PRINTING APPARATUS, CONTROLLING METHOD AND COMPUTER PROGRAM

BACKGROUND OF THE INVENTION

1. Field of the Invention

The present invention relates to a printing apparatus and more particularly to a printing apparatus having a construction that makes efficient use of power capacity of the apparatus, and a print control method and a program for the printing apparatus.

2. Description of the Related Art

As information processing equipment, such as copying machines, word processors and computers, and communication devices proliferate, more and more digital image forming (printing) apparatus that employ an ink jet printing system in outputting information processed by these devices, such as characters and images, are coming into widespread use. Ink jet printing apparatus generally use a print head which has a plurality of ink ejection printing elements and ink paths integrated therein as printing elements for faster printing speed.

Of the ink jet printing apparatus, serial printers that are inexpensive and easily reduced in size have found growing market demands as personal printers. In such serial printers, the number of printing element operations greatly varies depending on the content of image data supplied from a host computer. For example, even in one and the same page of a print medium, there is a distribution in print density according to a print location. In this case, an electric power required for driving the print head also varies according to the print density. To allow for a stable printing without being affected by such power variations, it is necessary to provide a power supply with a relatively large capacity and a circuit that can withstand input and output to and from the large-capacity power supply. It is, however, feared that such a printer may become large in size and expensive.

In normal printing, an image that the print head prints at a maximum print density is only a very small portion of the entire page. In most of the page, lower density images are printed at lower drive frequency output. Thus, printers intended for low cost and small size adopt a method that controls a printing method according to the number of printed dots in a predetermined area to limit the amount of electricity consumed per unit of time. That is, in printing general image data a fast print mode is used and, in areas that require a high resolution printing, another printing method is used to ensure a high print quality.

For example, Japanese Laid-Open Patent Application No. 55-119784 (1980) discloses a printing method that seeks to save electricity in a printing apparatus which has a plurality of printing elements (nozzles) arrayed in a paper feed direction and scans a printing element column in a direction perpendicular to the paper feed direction to form an image. The printing apparatus disclosed here includes: a drive signal generation means for generating printing element drive signals for activating the printing elements; a counter means for using the printing element drive signals from the drive signal generation means as a count input to count the number of dots required to form a character in each block resulting from a division of one line; a detection means for determining which of preset multiple stages a count value of each block produced by the counter means falls in; and a selection means for selecting, based on an output of the detection means, a print speed for one line under consideration according to the stage of the count value produced by the counter means for a block in the line having the largest number of dots to be printed.

The technique disclosed in the above document has been proposed mainly for a wire dot system and a line printer and reduces the power consumption per unit of time by reducing the print speed for one line.

Some other printers employ a method which divides data for an area that can be printed at one printing scan into two or more blocks of data and scans the print head a plurality of times in that area. For example, Japanese Patent Application Publication No. 6-47290 (1994) (U.S. Pat. No. 4,653,940) discloses a technique that prints one line in a plurality of scans when that line has an area with a dot duty in excess of a predetermined dot duty. As one method of printing one line in a plurality of scans, this document proposes printing the line in two scans by dividing the printing elements into even-numbered printing elements and odd-numbered printing elements.

There is another method for dividing an area that can be printed by the print head at one printing scan into two blocks of area. For example, all the printing elements in the print head may be divided into an upper half block and a lower half block, and the printing scan may also be divided into a first printing scan using only the upper half block and a second printing scan using only the lower half block. Another method involves using two print masks that are complementary to each other (here, they are grid-shaped) and completing an image area D in two printing scans. The difference among these methods lies in the way the printing of one and the same image area is divided into two printing actions.

This method does not limit to two the number of times that the printing operation is divided. The above document has a description to the effect that the number of divided printing operations is not limited to two but the printing operations may be divided into two or more.

Further, Japanese Patent No. 3376118 (U.S. Pat. No. 6,155,663) discloses a method of dividing data and performing a plurality of printing scans to complete an image in one area.

However, the conventional method described above, which, as in the divided printing, simply switches to a power save mode when the predetermined number of printed dots is exceeded, can hardly be said to utilize the power supply efficiently at all times within its service range. That is, since the print mode switches to the power save mode if the number of dots exceeds a threshold even by a small margin, the power supply is hardly used to near its maximum usable capacity and there is a possibility of only the printing time (throughput) increasing significantly.

In the method that reduces the speed of the printing scan to prevent the power consumption from exceeding the maximum capacity of the power supply, it is very difficult from the aspect of a motor performance to stably operate a print head scanning drive motor in a wide range from high to low speed. That is, the printing speed cannot be lowered unlimitedly according to the current flow and it is therefore required to select a scan speed within a range in which the drive motor can operate stably.

SUMMARY OF THE INVENTION

The present invention can overcome these problems and can provide a printing apparatus capable of using a power supply more efficiently without overly degrading a throughput.

In a first aspect of the present invention, there is provided a printing apparatus for printing an image on a print medium by a print head having a plurality of printing elements arrayed in a predetermined direction, while scanning the print head over the print medium in a direction different from the predetermined direction, the printing apparatus comprising: detection means for detecting the number of data indicating print for each of a plurality of blocks obtained by dividing a print area which is printable by the print head in one scan; comparison means for comparing a value detected by the detection means with a plurality of thresholds; and decision means for determining, based on a result of the comparison made by the comparison means, a scan speed of the print head and the number of scans of the print head required to print the print area.

In a second aspect of the present invention, there is provided a printing apparatus for printing a plural color image on a print medium by ejecting a plurality of inks having different colors from a print head having a plurality of printing elements, while scanning the print head over the print medium in a direction different from an arrangement direction of the printing elements, the printing apparatus comprising: detection means for detecting, for each of the color inks, the number of data indicating print for each of a plurality of blocks obtained by dividing a print area which is printable by the print head in one printing scan; comparison means for comparing a total of values for respective color inks detected by the detection means with a plurality of thresholds; and decision means for determining, based on a result of the comparison made by the comparison means, a scan speed of the print head and the number of scans of the print head required to print the print area.

In a third aspect of the present invention, there is provided a controlling method of a printing apparatus for printing an image on a print medium by a print head having a plurality of printing elements arrayed in a predetermined direction, while scanning the print head over the print medium in a direction different from the predetermined direction, comprising: a detection step for detecting the number of data indicating print for each of a plurality of blocks obtained by dividing a print area which is printable by the print head in one printing scan; a comparison step for comparing a value detected by the detection step with a plurality of thresholds; and a decision step for determining, based on a result of the comparison made by the comparison step, a scan speed of the print head and the number of scans of the print head required to print the print area.

In a fourth aspect of the present invention, there is provided a computer program which makes a computer perform information processing of a printing apparatus, the printing apparatus prints an image on a print medium by a print head having a plurality of printing elements arrayed in a predetermined direction, while scanning the print head over the print medium in a direction different from the predetermined direction, the computer program comprising: a program code for detecting the number of data indicating print for each of a plurality of blocks obtained by dividing a print area which is printable by the print head in one printing scan; a program code for comparing a value detected with a plurality of thresholds; and a program code for determining, based on a result of the comparison, a scan speed of the print head and the number of scans of the print head required to print the print area.

The above and other objects, effects, features and advantages of the present invention will become more apparent from the following description of embodiments thereof taken in conjunction with the accompanying drawings.

BRIEF DESCRIPTION OF THE DRAWINGS

FIG. 9 is a table showing thresholds set for different print modes;

FIG. 10 is a table showing printing methods set for different print modes;

FIG. 12 is a schematic diagram showing black and color dot count blocks.

DETAILED DESCRIPTION OF PREFERRED EMBODIMENTS

Embodiments of this invention will be described by referring to the accompanying drawings.

(Outline of Apparatus)

Figure 1:
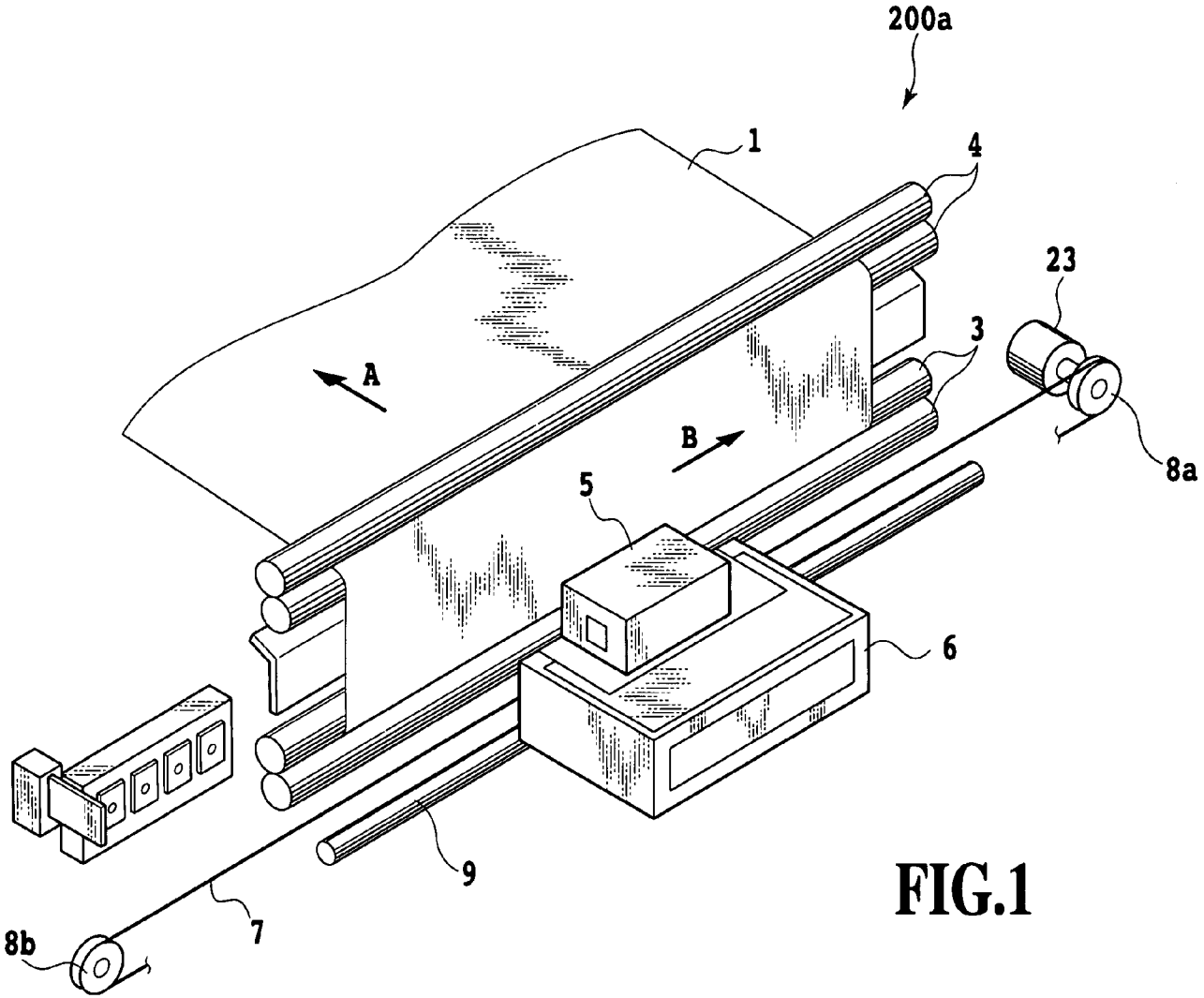
FIG. 1 is a schematic view of a printing section of an ink jet printing apparatus applied in an embodiment of this invention.

FIG. 1 is a schematic view of a printing section 200*a* in an ink jet printing apparatus as one embodiment of this invention.

Designated as 1 is a print sheet (print medium) made of paper or plastic sheet and a plurality of sheets are stacked in a cassette (not shown). When a print start command is input, a supply roller (not shown) in contact with one side of a top or bottom sheet of the stacked sheets rotates to feed print sheets, one at a time, at a predetermined interval until the print sheet is placed on a platen. The print sheet 1 on the platen is then transported in a direction of arrow A (also referred to as a "sub-scan direction") by a pair of first transport rollers 3 and a pair of second transport rollers 4, driven by associated stepping motors (not shown).

Denoted 6 is a carriage which is linearly reciprocally movable along a guide shaft 9 held horizontal in a main scan direction B perpendicular to the sub-scan direction A. The carriage 6 is driven by a carriage motor 23 through a belt 7 and pulleys 8*a*, 8*b*. As the carriage motor 23 is energized, the carriage 6 is reciprocated along the guide shaft 9. The carriage 6 mounts a print head 5. The print head 5 is disposed so that its printing element face including a plurality of printing elements (printing elements) faces the print medium 1.

In the printing section with the above construction, the print head 5 ejects ink onto the print sheet 1 according to a print signal as it moves together with the carriage 6 in the direction of arrow B (also referred to as a "main scan direction"). A strip of area with a width corresponding to the number of printing elements in the print head 5 is printed.

The print head 5 returns to its home position as needed where its printing elements are cleared of clogging ink by a recovery device. When the print head 5 completes one scan over the print medium, the two pairs of transport rollers 3, 4 are driven to feed the print sheet 1 a distance equal to one scan print area in the direction of arrow A. As described above, the printing scan of the print head 5 and the transport of the print medium over a predetermined distance by the transport rollers 3, 4 are alternated until an image is formed on the entire print medium.

On both sides of the print sheet 1 in the main scan direction, a preliminary ejection opening (not shown) is provided. Prior to starting the print operation in either of the forward and backward directions, the print head 5 can execute the preliminary ejection.

Figure 2:
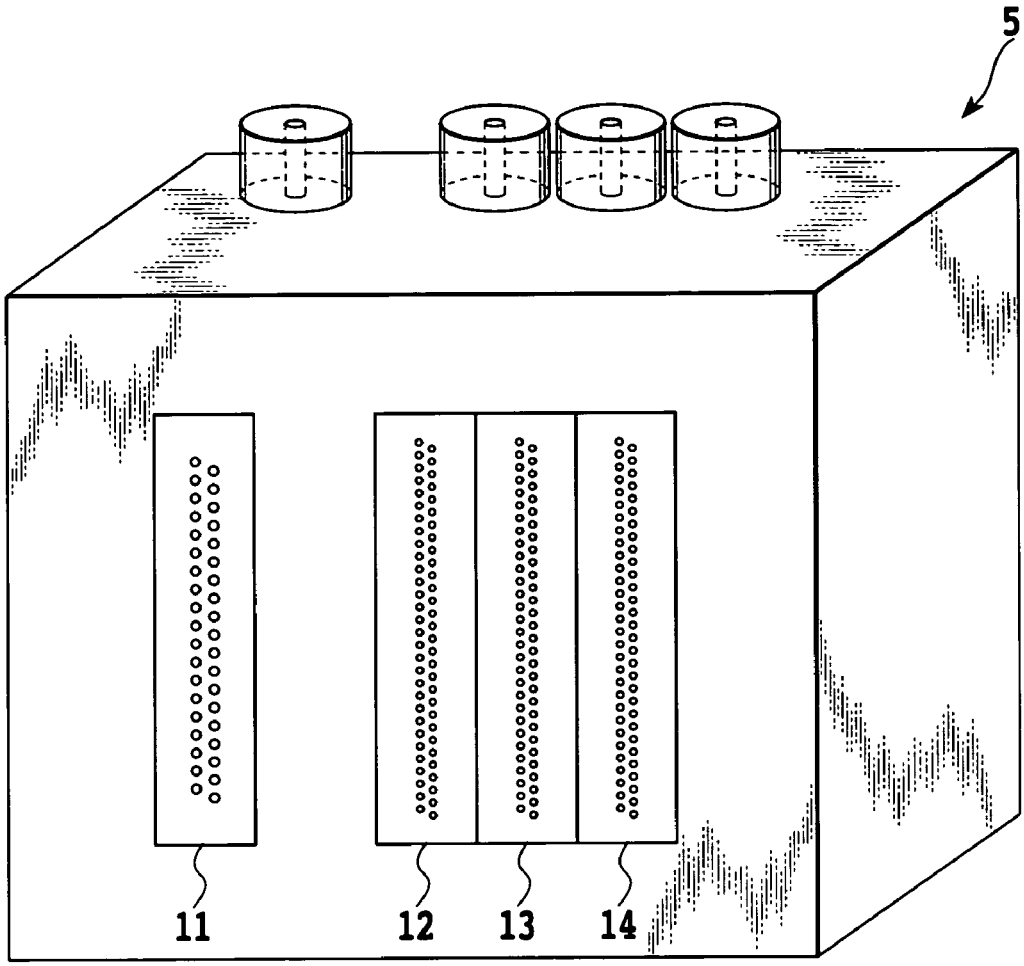
FIG. 2 is a schematic perspective view of a print head applied in an embodiment of this invention.

FIG. 2 shows a schematic external view of the print head 5. As shown in the figure, a black chip 11 has 640 printing elements arranged so that they can print at a density of 600 dpi (dots/inch). A color head (cyan chip 12, magenta chip 13 and yellow chip 14) has 1280 printing elements arranged for each color so that they can print at a density of 1200 dpi.

Figure 3:
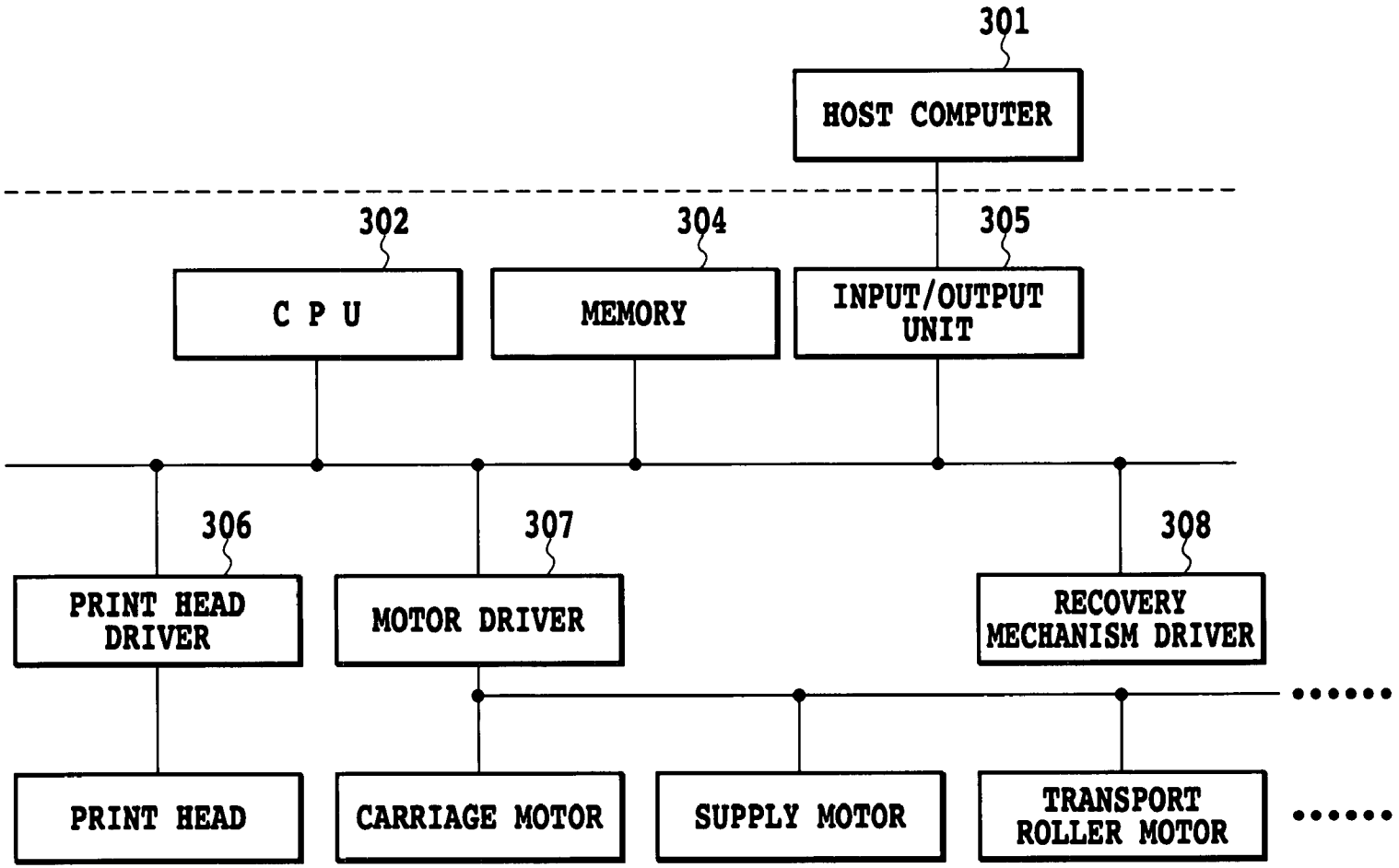
FIG. 3 is a block diagram showing an electric configuration of the ink jet printing apparatus applied in an embodiment of this invention.

FIG. 3 is a block diagram showing an electric configuration of the ink jet printing apparatus. Denoted 302 is a CPU constructed of a microprocessor or the like. Reference number 304 represents a memory which includes a ROM storing a control program and various data and a RAM used as a work area for the CPU 302 and for temporarily storing various data such as image data to be printed. The RAM includes a print buffer storing binary print data of Cyan, Magenta, Yellow and Black. The print buffer of each color stores the binary data indicating print or non-print. The binary data stored in the print buffer is read out by the CPU 302, and is transferred to the print head. The print head performs printing operation according to the each of the binary data transferred. Reference number 305 denotes an input/output unit to receive multilevel data from a host computer 301 and to output a state of the ink jet printing apparatus to the host computer. The multilevel data input to the input/output unit 305 is converted into the binary data above-mentioned.

Denoted 306 is a print head driver which controls the operation of the print head according to a drive signal from the CPU 302. Denoted 307 is a motor driver that controls the operation of motors, such as carriage motor, paper supply motor and transport roller motor, according to a drive signal from the CPU 302. Also provided in the apparatus is a recovery mechanism driver 308 to drive a recovery mechanism such as a suction pump.

CPU 302, according to various information (e.g., character pitch, character kind, etc.) input from the host computer 301 via the input/output unit 305, starts a control program stored in the memory to operate the associated drive units.

First Embodiment

Based on the above construction, a first embodiment of this invention will be described. In this embodiment a print mode that executes printing by using only a black ink will be explained. In more detail, an area on the print medium having the width corresponding to the black printing element array, which is printed by the print head in one scan, is divided into a plurality of blocks, the number of black dots to be actually printed is counted for each block and, based on the result of dot counts, a printing method (in particular the scan speed of the print head and the number of scans of the print head) is determined.

Figure 4:
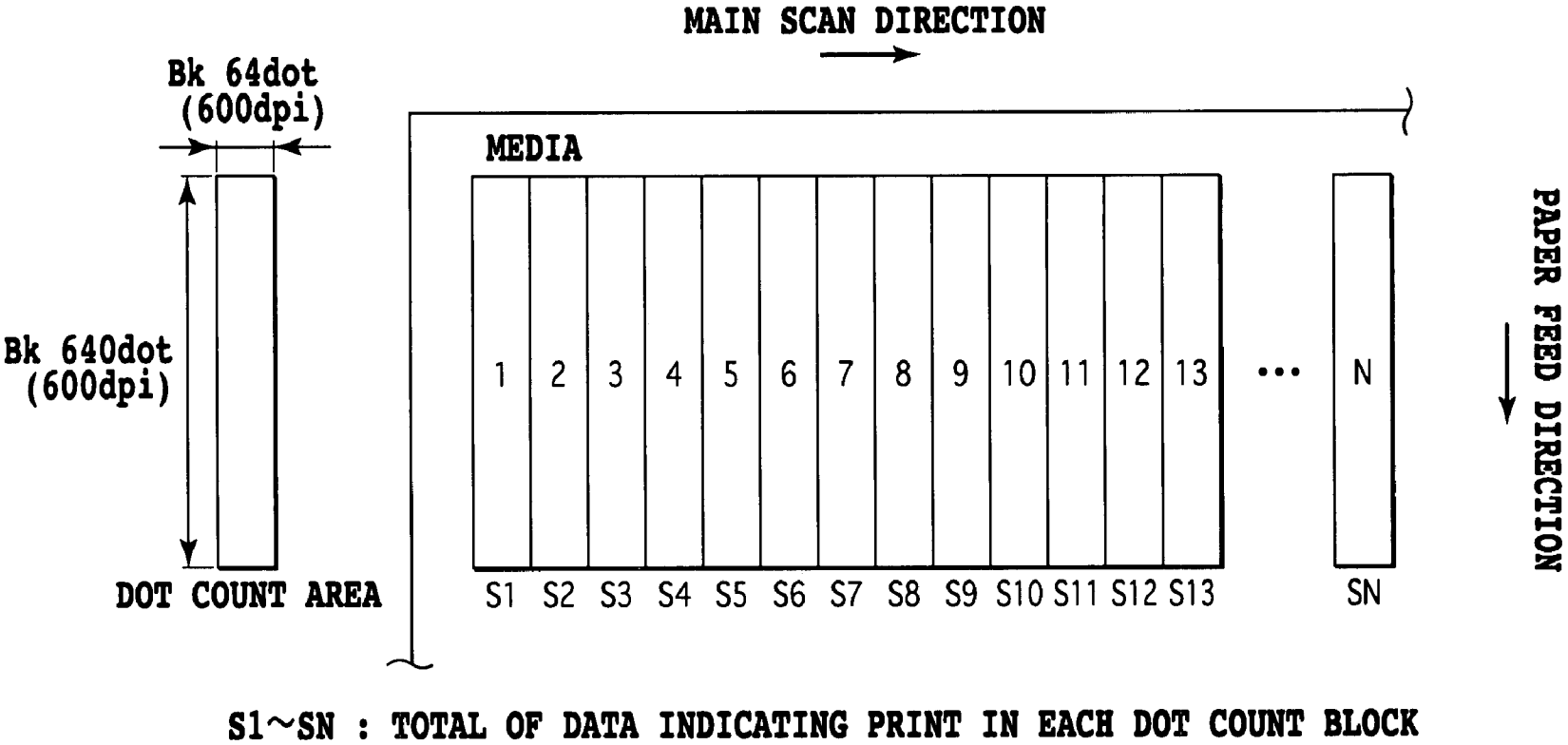
FIG. 4 is a schematic diagram showing a dot count block.

FIG. 4 is a schematic diagram showing blocks of print areas for dot count, wherein the inside of the print buffer of black appears. This print buffer stores the black print data of the area which is able to be printed by the print head in one scan. This black print data is formed with the binary data indicating print and the binary data indicating non-print of black ink. Here, the black print data of an area which is 640 dots wide in the sub-scan direction and 4800 dots wide in the main scan direction is stored, as black print data for the area which is able to be printed by the print head in one scan.

In this embodiment, the area having the arrange width of black printing element (640 dot; in FIG. 4) and the region width of printing in the main scan direction (4800 dot; in FIG. 4), is divided in the main scan direction into N units. One unit area is defined as "a block" for dot counting. In this embodiment, the print width in the main scan direction of 8 inches (4800 dot in 600 dpi) is divided by N=75. Each block has 640 dots wide in the sub-scan direction and 64 dots wide in the main scan direction (600 dpi). In each block, data "1" for ejection or data "0" for non-ejection is assigned to each of vertically arrayed 640 dots times horizontally arrayed 64 dots.

Each of S1-SN is a total number of data indicating print (number of times for nozzle operation), which is obtained by counting only the ejection data "1" in each block. The data indicating print is counted for each block as described above. Although it is not limited how to count the data indicating print, a suitable example is explained here. The block which is the target of dot count processing is chosen as an attention block among the 1st to the Nth blocks. Next, the print data for black stored in the attention block is read out in a predetermined unit. If "a predetermined unit" is in agreement with the size of a block, the print data for black stored in the attention block will be read only once. Counting the number of the data indicating print among the read out data, the count value will be a dot count value of the attention block. On the other hand, if "a predetermined unit" is equivalent to 1/M of a block size (for example, 16 dot×16 dot), the print data for black stored in the attention block will be divided into some predetermined units, and will be read out M times. The number of the data indicating print is counted, and these M times of count values are added. The additional value serves as a dot count value of the attention block (the U.S. Pat. No. 6,155,663).

The dot count value in each block is corresponding to the amount of current which flows into the print head per unit time. Therefore, it can be judged whether the power consumption of the print head per unit time exceeds the electric energy which can be supplied to the print head per unit time, by comparing the dot count value of each block with the threshold value corresponding to the electric energy which can be supplied to the print head per unit time.

In the above method of dot counting for each block, the reason that 64 dots of data in the horizontal (main scan) direction are taken into consideration in addition to the vertical column of dots used for simultaneous operation is as follows.

Generally, a capacitor is used to supply a driving power and printing is performed according to the data in those columns arranged in the main scan direction depending on the capacity of the capacitor. Thus, based on the amount of electricity used to print one dot, the amount of electricity consumed as the printing operation proceeds can be determined. By comparing the value determined and the amount of electricity accumulated in the capacitor per unit of time, it is possible to set the amount of print data for which power can be supplied. Therefore, the size (width) of each block is preferably determined by considering the relation with the capacitor's capacitance.

The use of a capacitor with a large capacitance allows for an increased width of block, shortening the time taken to calculate the dot count. On the other hand, when a capacitor with a small power capacity is used or when a head with a greater number of printing elements is used, the horizontal width of each block needs to be made small. It is preferred that the block size be set so that the print speed is not affected by the calculation time. In either case this invention is applicable.

Next, how a printing method is determined according to the result of dot count will be explained.

Figure 5:
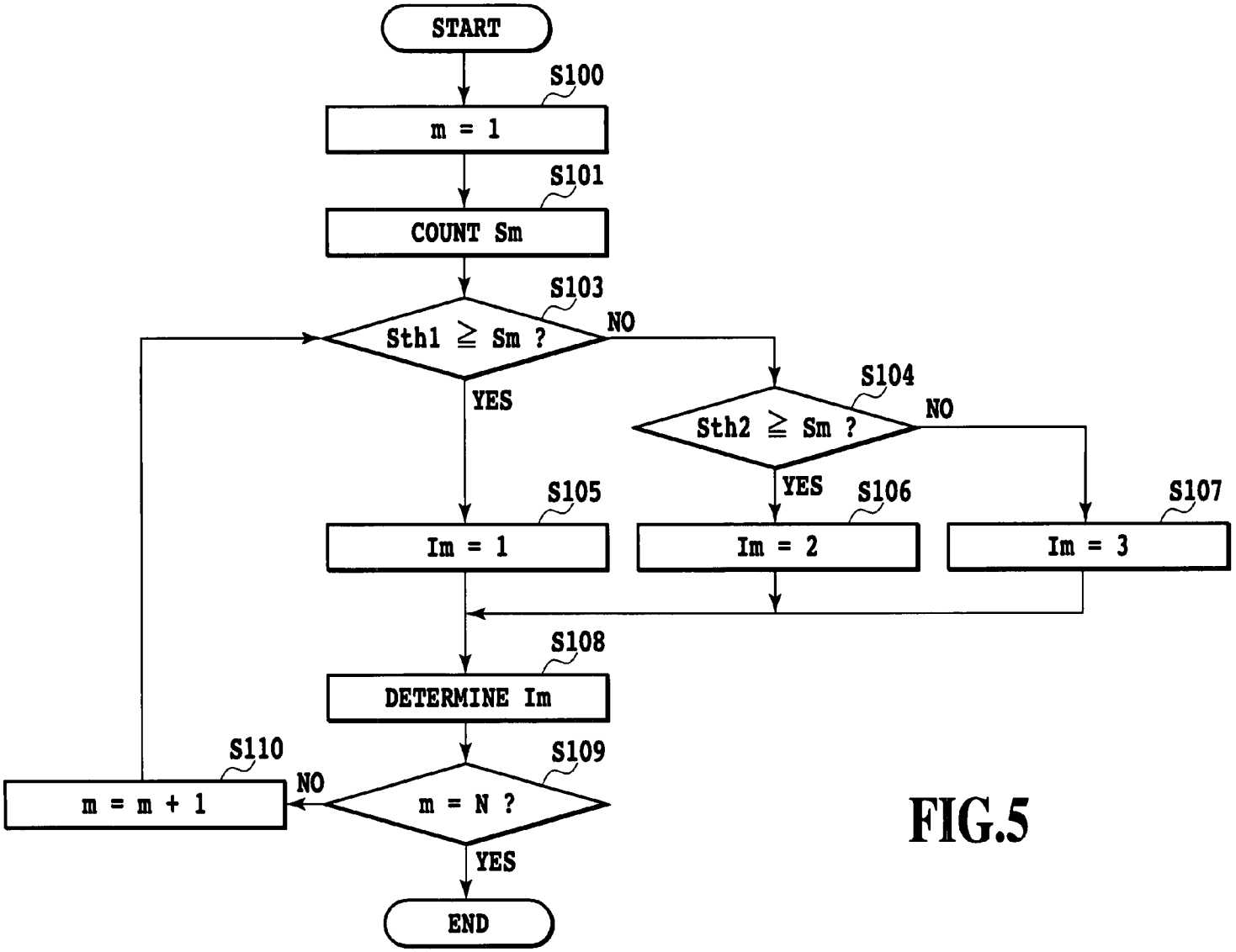
FIG. 5 is a flow chart showing processing to determine a print method according to a result of dot count.

FIG. 5 is a flow chart showing a procedure for determining a printing method from the result of dot count. A value Sth1 used in this processing is a first threshold and a value Sth2 is a second threshold. These thresholds represent the number of dots that can be printed in one block. When a greater number of dots than these thresholds are printed, this means that a current in excess of the maximum capacity of the power supply flows. These thresholds are values determined by considering the power capacity of the printing apparatus, the electricity required to print one dot, or the drive frequency. Sth1 is a threshold calculated under the condition of a drive frequency of Fop1 (carriage scan speed of CS1) and Sth2 is a threshold calculated under the condition of a drive frequency of Fop2 (<Fop1; carriage scan speed of CS2). Lowering the drive frequency means that the threshold is calculated with a slower printing scan speed. Symbol I represents a printing method.

Figures 6, 7:
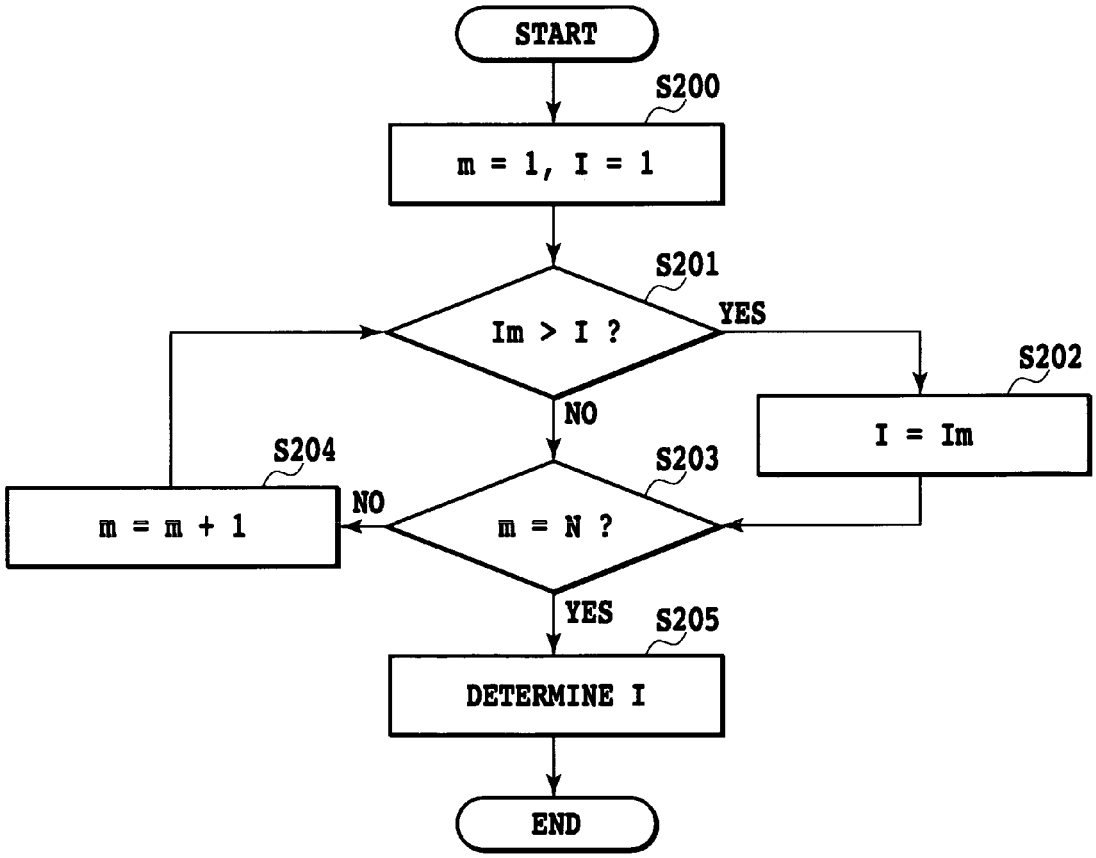
FIG. 6 is a table showing details of different printing methods.
FIG. 7 is a flow chart to determine a print mode I by using Im of the dot count block.

FIG. 6 shows a table showing details of a printing method I. A printing method 1 is a fastest printing method that can perform the printing scan at the scan speed CS1. A printing method 2 is one that prints at the scan speed CS2. A printing method 3 is a slowest printing method that prints at the scan speed CS2 and which also uses a divided printing described later. In this embodiment, it is assumed that printing is done by one of the three printing methods I=1, 2, 3. The kind of print mode is determined by the following processing.

This processing is started for each printing scan. First, in step S100 of FIG. 5, a block to be processed is determined by setting m=1 and a memory area involved in this processing, for instance a register, is initialized.

In step S101 the number of data indicating print in the attention block is counted to determine a total number of data indicating print (a total number of printing element operation) in the attention block, Sm.

In the subsequent step S103, Sm obtained by step S101 is compared with Sth1. If Sth1≧Sm, Im=1 is set (step S105); and if Sth1<Sm, processing proceeds to step S104. In step S104 a comparison is made between Sm and Sth2. If Sth2≧Sm, processing moves to step S106 where Im=2 is set. If Sth2<Sm, then processing moves to step S107 where Im=3 is set.

When with the above process Im is determined (step S108), processing proceeds to step S109 where a check is made as to whether m=N. If m≠N, step S110 increments m and step S101 to step S109 are repeated until m=N. With the above process Im is determined for each of all blocks.

FIG. 7 is a flow chart for determining a print mode I for a print area of interest by using Im for each block obtained in the above procedure.

In step S200 m=1 and I=1 are set and the processing moves to step S201. In step S201 a comparison is made between Im and I. If Im>I, processing moves to step S202 where I=Im is set. If not, processing moves to step S203. In step S203 a check is made to see if m=N. If m≠N, step S204 sets m=m+1 and returns to step S201, so that the above process is repeated until m=N is reached.

If step S203 decides that m=N, processing proceeds to step S205 where the largest of all Im is selected as the print mode I.

Figure 8B:
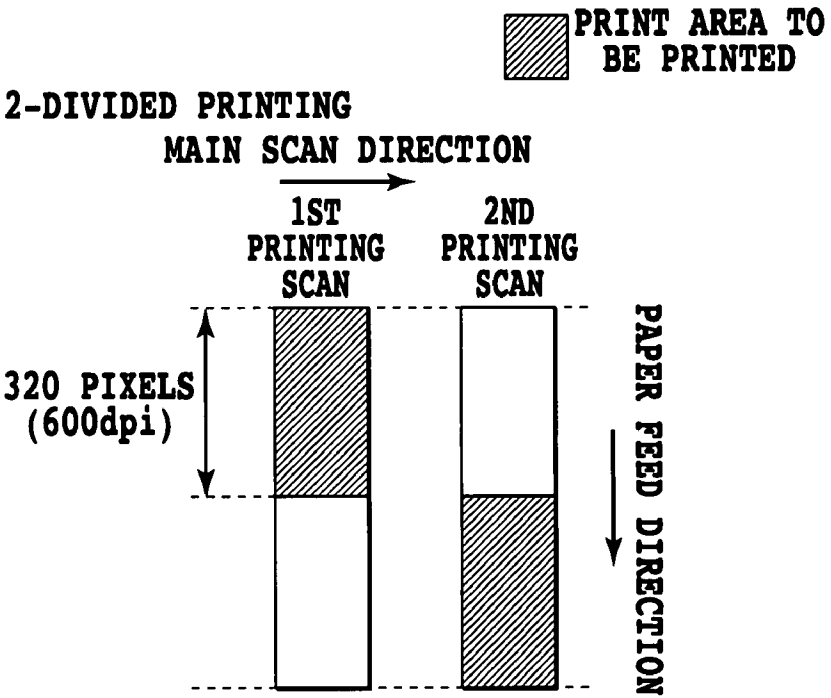
FIGS. 8A to 8C are schematic diagrams showing divided printing methods.
Figure 8A:
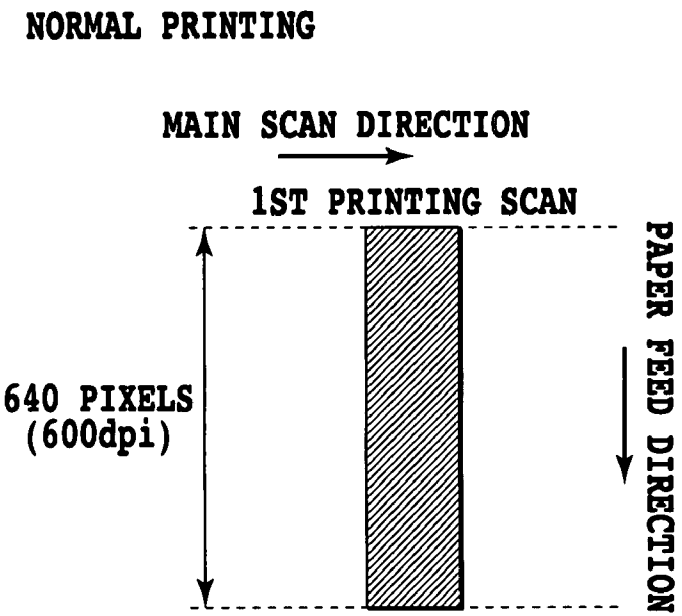
Figure 8C:
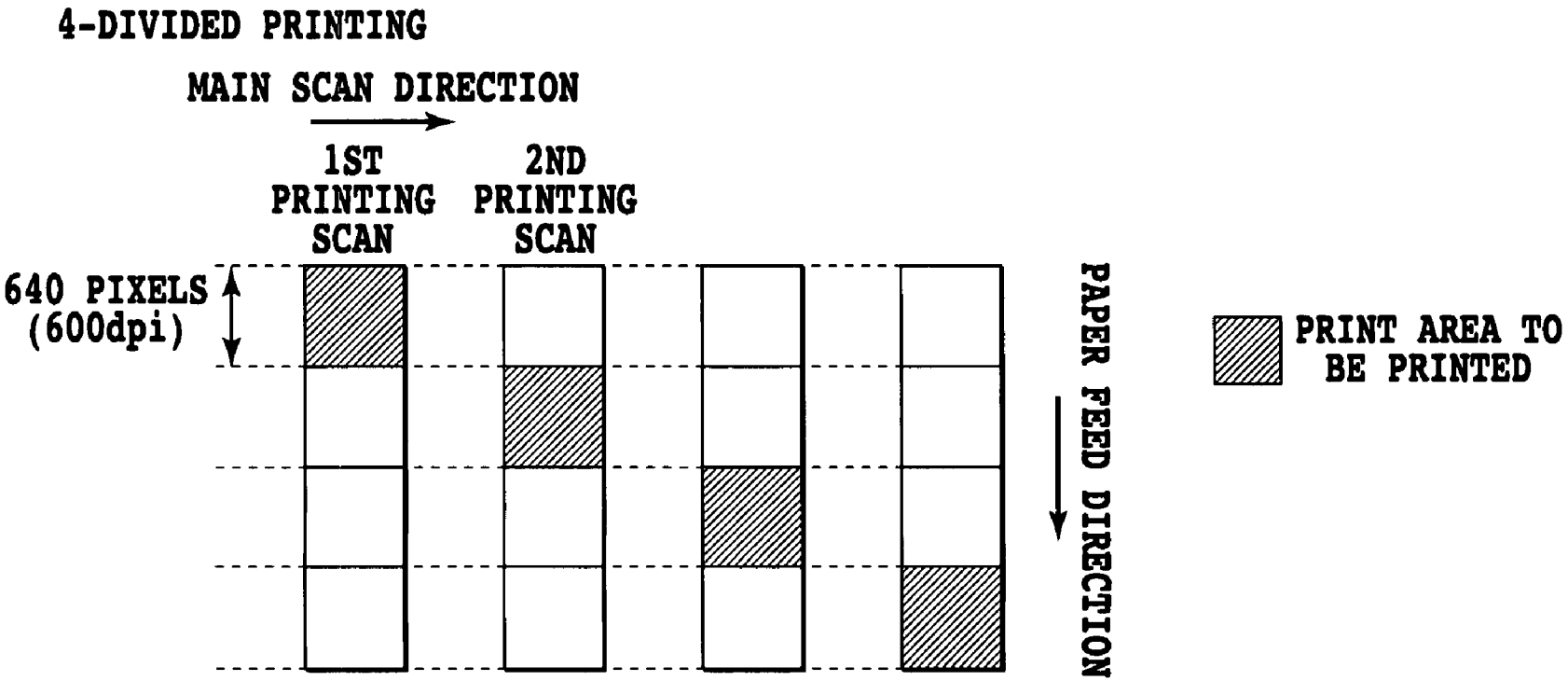

FIG. 8A to FIG. 8C are schematic diagrams showing how a divided printing is performed. Although the divided printing in this embodiment is performed in up to two divided operations, a four-divided printing will also be explained here. Further, while the operations shown in the figures have a print mode during the normal printing set to a 1-pass printing, the printing apparatus can be similarly handled if the print mode during the normal printing is set to a 2-pass printing. In that case the data to be printed in one printing scan is divided and printed in two or more scans.

FIG. 8A shows a print area covered by the normal printing scan. In this embodiment, the print head is constructed to be able to print data for 640 pixels (600 dpi) in one printing scan.

However, if printing all data in one printing scan results in a current flow higher than the threshold, a two-divided printing such as shown in FIG. 8B is executed. During the two-divided printing, the print data is printed in two printing scans. A first printing scan prints print data corresponding to the upper half of the print head. Then, without feeding the sheet, the second printing scan prints data corresponding to the lower half of the print head. By dividing the print data and printing it in two scans as described above, it is possible to prevent a current flow from exceeding the threshold.

FIG. 8C shows a printing state in a four-divided printing. In a first printing scan print data corresponding to a top one-fourth of the print head is printed; in a second printing scan print data corresponding a one-fourth of the print head below the first printing scan is printed; in a third printing scan print data corresponding to a one-fourth of the print head below the second printing scan is printed; and in a fourth printing scan print data corresponding to the remaining one-fourth of the print head is printed. Even in the two-divided printing if a current in excess of the threshold flows, such a four-divided printing may be performed to prevent a current flow from exceeding the threshold. Similarly, if the threshold is exceeded even in the four-divided printing, the number of divisions may be increased to eight, 16 and so on. It is also possible to perform a three-divided printing and a six-divided printing as needed.

In the above embodiment, each of the three printing methods is provided with two choices in the carriage speed and in the divided printing method. It is also possible to provide additionally selectable printing scan speeds or increase the number of divisions for the divided printing. In that case, the number of printing methods need also be increased according to the increased number of divisions and speeds and a comparison is made between thresholds and currents calculated under individual conditions to determine a final printing method.

In the above embodiment, it is assumed that the two carriage speeds CS1 and CS2 meet the condition of CS1<2× CS2. This means that even if the printing method is changed from the printing method 1 to the printing method 2, the scan speed of the print head does not fall below one-half. As one method of saving electricity by changing the printing method, it is conceivable to adopt the two-divided printing while still in the stage of printing method 2. However, since the two-divided printing performs the printing scan two times over the same image area, it takes about twice as much printing time as when no divided printing is performed. This embodiment therefore changes the print speed from CS1 to CS2, which is slower than CS1 but not as slow as one-half of CS1, to prevent the print time from becoming overly extended and to make effective use of the power supply capacity available.

As described above, with this embodiment, by comparing a plurality of thresholds with the number of dots of print data and by providing a plurality of printing methods corresponding to these thresholds, the limited power supply can be used to its maximum capacity and at the same time the print speed can be kept from being reduced as much as possible during printing.

In the example shown with this embodiment, if it is impossible to print an area by one printing scan, at first, the scan speed is changed lower. When it is impossible still to print the area by one printing scan, the dividing printing is carried out in condition with the lower scan speed. However, it is indispensable to perform dividing printing at lowered scan speed. For example, if Sth1>=Sm, 1-pass printing by high-speed scanning CS1 may be performed like the above-mentioned example, if Sth2>=Sm>Sth1, 1-pass printing by low-speed scanning CS2 may be performed like the above-mentioned example, and if Sm>Sth2, 2-pass printing by high-speed scanning CS1 may be performed unlike the above-mentioned example.

Second Embodiment

In this embodiment, a printer will be explained which has a plurality of print modes according to kind of print media and print quality. As in the first embodiment, this embodiment takes up a case where only a black ink is used in printing. This embodiment, however, is acceptable to a case where a plurality color ink is used in printing.

In the printer of this embodiment, two kinds of print media, media A and media B, can be used. For each media, one of two print modes, "standard" and "fine", is selectable.

FIG. 9 is a table of thresholds set for individual print modes. FIG. 10 is a table of printing methods set for individual print modes.

In FIG. 9, the standard mode for media A has three different thresholds, Stha1, Stha2 and Stha3, and the fine mode has two thresholds, Sthb1 and Sthb2. For media B, the standard mode has two thresholds Sthc1 and Sthc2 and the fine mode has only one threshold Sthd1.

In FIG. 10, the standard mode for media A has four different printing methods, of which a printing method 1 prints at a printing scan speed of CS1, a printing method 2 prints at a printing scan speed of CS2, a printing method 3 prints at a printing scan speed of CS2 and performs a two-divided printing, and a printing method 4 prints at a printing scan speed of CS2 and performs a four-divided printing. The fine mode for media A has three different printing methods, of which a printing method 1 prints at a printing scan speed of CS1, a printing method 2 prints at a printing scan speed of CS2, and a printing method 3 prints at a printing scan speed of CS2 and performs a two-divided printing. The standard mode for media B has three different printing methods, of which a printing method 1 prints at a printing scan speed of CS3, a printing method 2 prints at a printing scan speed of CS4, and a printing method 3 prints at a sprinting scan speed of CS5. The fine mode for media B has two different printing methods, of which a printing method 1 prints at a printing scan speed of CS3 and a printing method 2 prints at a printing scan speed of CS4. The number of printing methods is equal to one added to the number of thresholds set for each print mode. The thresholds in the above threshold table are calculated from various conditions for each printing method in each print mode, including drive frequency, the number of printing elements, and block size for dot count.

Next, how the printing method is determined for each print mode will be explained by taking up an example case where a standard mode for media A is selected. First, on a printer driver in a host computer a user selects a kind of a medium and print quality. When a print start command based on set conditions is sent to the printer, a threshold (Sthc1-3) and a plurality of printing method (method1-4) that match the standard mode for media A are read out from the threshold and printing method tables stored in a ROM and set in a register or the like.

Next, as in the first embodiment, a dot count value in each block is compared with the thresholds set in the register to determine a printing method selected from plurality printing method (method1-4) set in the register basing on the comparison result.

Figure 11:
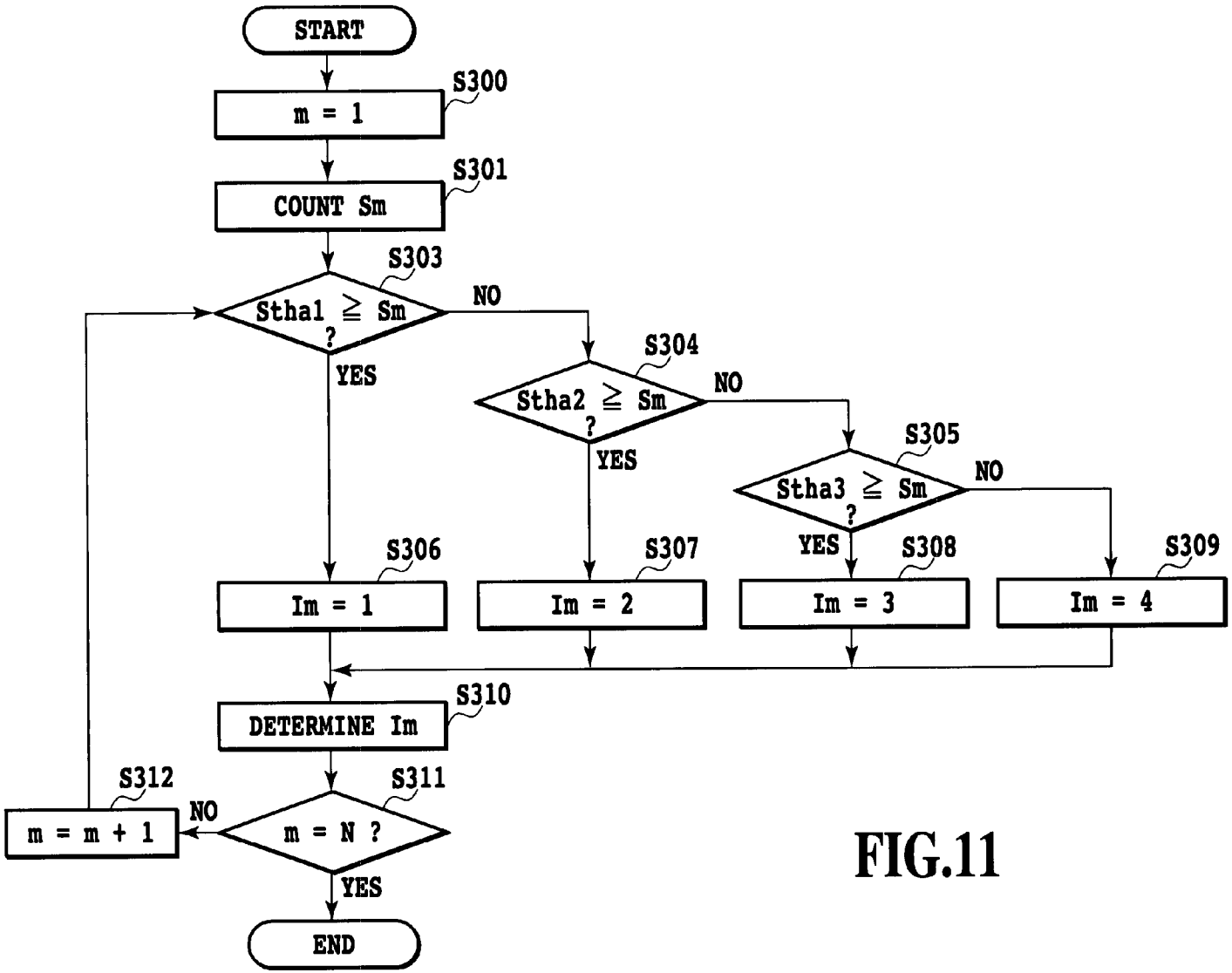
FIG. 11 is a flow chart showing processing to determine the printing method from the dot count result.

FIG. 11 is a flow chart showing processing to determine a printing method from a dot count result.

First, in step S300 a block to be processed is determined by setting m=1 and a memory area involved in this processing such as register is initialized. In step S301 the number of data indicating print in the attention block is counted to determine the total number of data indicating print (total number of printing element operations) in the attention dot count block, Sm.

Next, in step S303, Sm thus determined is compared against the value of Stha1. If Stha1≧Sm, Im=1 is set. If not, the processing moves to step S304. In step S304 Sm and Stha2 are compared. If Stha2≧Sm, the processing proceeds to step S307 where Im=2 is set. If in step S304 Stha2≧Sm fails to be established, the processing proceeds to step S305. In step S305 Sm is compared against the value of Stha3. If Stha3≧Sm, the processing moves to step S308 where Im=3 is set. If in step S305 Stha3≧Sm is not established, the processing moves to step S309 where Im=4 is set.

With Im determined in the above process (step S310), the processing moves to step S311 which checks if m=N. If m≠N, step S312 increments m before returning to step S303. That is, step S303 to step S310 are executed for all blocks 1-N to determine Im. Then, this processing is ended.

After this, processing similar to that of the first embodiment that was executed according to the flow chart of FIG. 7 is performed. That is, the largest of all Im is taken as I to determine the printing method.

When other print mode is selected, the similar procedure needs only to be followed to determine the printing method.

This embodiment uses threshold and printing method tables prepared beforehand to determine the final printing method. The printing method may also be determined in the printer by calculating a threshold for each print mode based on such information as drive frequency, the number of printing elements and the number of passes.

(Modification)

In the second embodiment, the case where only black ink was used for printing is explained. Therefore, the dot count value of black is adopted as the dot count value in comparison with a threshold. However, this embodiment is not limited to the case of using black ink only. This embodiment can be applied also the case of using other colors than black. When applying the second embodiment to the case of using other colors than black, the sum total of each color dot count value, such as black, cyan, magenta, and yellow, is adopted as a dot count value in comparison with a threshold. That is, the sum total value of each color and threshold are compared, and the printing method is determined based on the comparison result. In addition, the technique of calculating the sum total value of each color may just apply the technique explained with the third embodiment below-mentioned. According to the above modifications, even if it is a case where two or more colors are used for printing, a suitable printing method is set for the kind of printing medium and the print quality.

Third Embodiment

In this embodiment a printing operation is described in which cyan, magenta and yellow inks as well as black ink are printed simultaneously. In such this embodiment, the area on the print medium corresponding to the width of each color printing elements arrangement printable by one scan of a print head is divided. Next, the number of each color dots actually printed is counted in the plurality block of each. Based on the result, the printing method (specifically the speed of scan and the number of times of a scan of the print head) is determined.

FIG. 12 is a schematic view showing dot count blocks for black ink and color inks, wherein the inside of the print buffer of Cyan(C), Magenta(M), Yellow(Y), and Black(K) is appeared. The print data for CMYK corresponding to an area printable by one scan of the print head is stored in each of the print buffer for CMYK. Each of the print data for CMYK consists of binary data indicating print and binary data indicating non-print of CMYK ink. Also in this embodiment, a unit area is obtained by a division into N of an area printable by one scan of the print head in the main scan direction, and is determined as a "block" like the first embodiment mentioned above. The size of one block is 640 dots in the sub-scan direction×64 dots in the main scan direction (600 dpi) for black and 1280 dots in the sub-scan direction×128 dots in the sub-scan direction (1200 dpi) for color (cyan, magenta and yellow). In each block for black, data "1" indicating ejection or data "0" indicating non-ejection is assigned to each of vertically arrayed 640× horizontally arrayed 64. In each block for color, data "1" indicating ejection or data "0" indicating non-ejection is assigned to each of vertically arrayed 1280×horizontally arrayed 128.

Sk1-SkN for black are a total number of data indicating print (a total number of printing element operations) in 1st to Nth block, respectively, which is obtained by counting only the ejection data "1" in each block, the 1st to Nth blocks being arranged in the main scan direction. Similarly, Sc1-ScN for cyan, Sm1-SmN for magenta and Sy1-SyN for yellow are a total number of data indicating print (a total number of printing element operations) in each block of the associated color obtained by counting only the ejection data "1" in the block.

In the first and second embodiment, since only a black ink is used for printing, only black data indicating print is counted to decide whether an electric current will exceed a threshold. In this embodiment, a total amount of current that will be applied to the print head is estimated from the total number of printing element operations for each color to make a decision as to whether a current in excess of a threshold will flow in the print head. Therefore, comparison with the thresholds is made by using a sum of the count values of black, cyan, magenta and yellow.

If power consumption for one printing element operation (to form one printed dot) is equal for all colors, the count values of different colors need only be added up. However, when the power consumption differs among different colors, a ratio between a power consumption of a reference color and a power consumption of each color must be considered and the count values converted accordingly. In this embodiment, the power consumption for one printing element operation is almost equal among the different colors, but black has different power consumption than those of colors. It is assumed that the single printing element operation for black consumes a times more power than colors. Therefore, when the power consumption of colors is taken as a reference, the total number of printing element operations in each block is calculated as Sn=aSkn+Scn+Smn+Syn (n=0, 1, 2, . . . , N).

Subsequent processing is similar to that in the first embodiment. That is, processing in the flow charts of FIG. 5 and FIG. 7 is executed to determine the printing method. Then, using the printing method thus determined, actual printing is performed.

Fourth Embodiment

In this embodiment an explanation will be given to an example case in which a divided printing different from that explained in the first embodiment is employed.

Figure 13B:
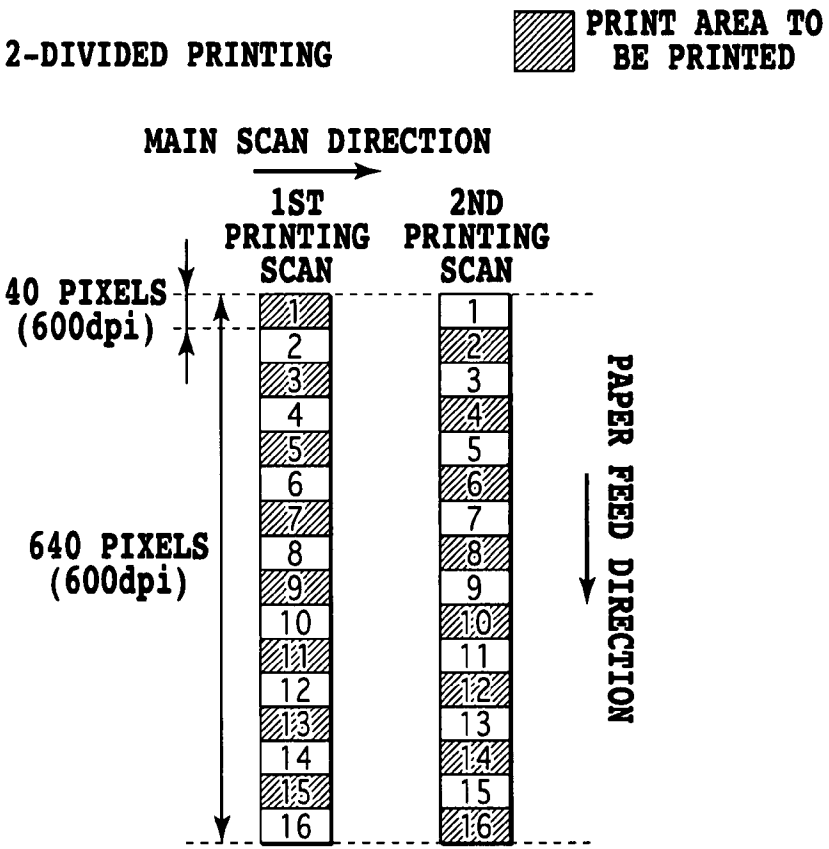
FIGS. 13A to 13C are schematic diagrams showing divided printing methods in a fourth embodiment of this invention.
Figure 13A:
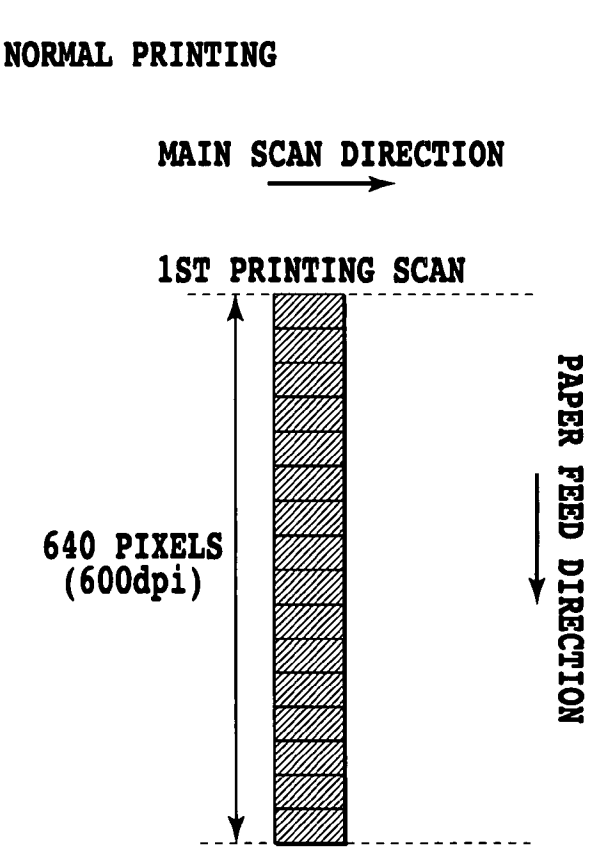
Figure 13C:
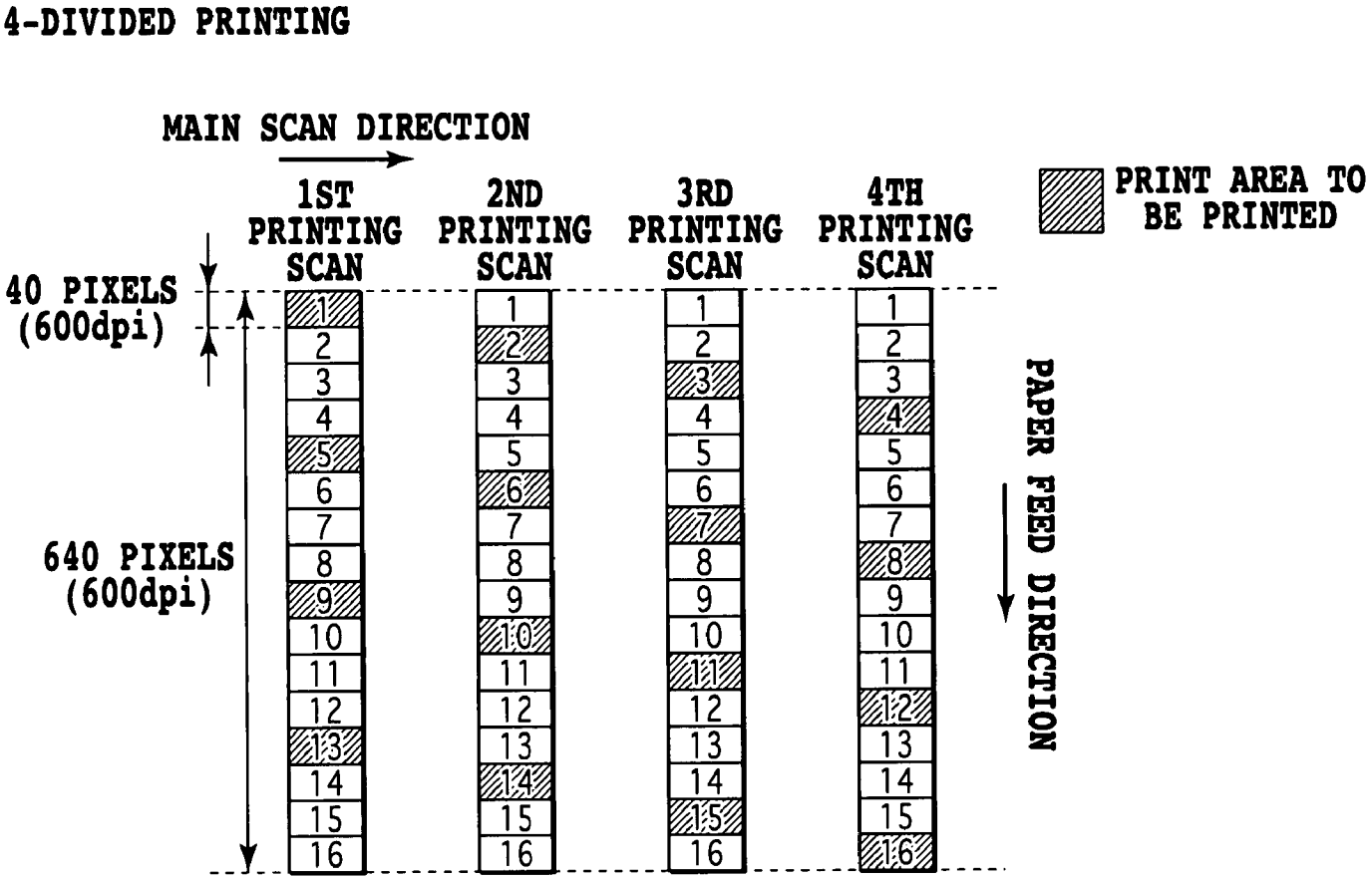

FIGS. 13A-13C are schematic diagrams showing how divided printings in this embodiment are performed. Although FIGS. 13A-13C represent a case for one-pass printing, divided printing with two or more passes can be accomplished with similar operations. That is, the data to be printed in one printing scan need only be divided and printed in two or more passes. FIG. 13A, FIG. 13B and FIG. 13C show printing methods for a normal printing, for a two-divided printing, and for a four-divided printing, respectively. While FIGS. 13A-13C show only the two- and four-divided printing, it is also possible to realize three-, six- and eight-divided printing in a similar manner.

As shown in FIG. 13A, the width in the paper feed direction of the data printed in one printing scan is normally 640 pixels (600 dpi), which is corresponding to the head width. However, in cases where printing all data in one printing scan causes a current in excess of a threshold, a two-divided printing such as shown in FIG. 13B is performed. Here, the print head is divided into 16 blocks of 40 pixels (600 dpi) each. In a first printing scan, print data covered by odd-numbered blocks, which include 1st, 3rd, 5th, 7th, 9th, 11th, 13th and 15th block, counting from the top block, is printed. In a second printing scan, without executing the paper feed operation following the first printing scan, print data covered by even-numbered blocks, which include 2nd, 4th, 6th, 8th, 10th, 12th, 14th and 16th block, is printed. Printing the print data in two divided scans as described above can prevent the current flowing from exceeding the threshold.

In the case of 4-divided printing, as shown in FIG. 13C, the print data is divided into four printing scans. Here, the print head is divided into 16 blocks of 40 pixels (600 dpi) each. In a first printing scan, print data covered by 1st, 5th, 9th and 13th block, counting from the top block, is printed. In a second printing scan, without executing the paper feed operation following the first printing scan, print data covered by 2nd, 6th, 10th and 14th block is printed. Further, in a third printing scan, without executing the paper feed operation following the second printing scan, print data covered by 3rd, 7th, 11th and 15th block is printed. In a fourth printing scan, without executing the paper feed operation following the third printing scan, print data covered by 4th, 8th, 12th and 16th block is printed. If a current in excess of a threshold flows even when the 2-divided printing is executed, the print data may be divided into four printing scans to prevent a current from exceeding a threshold.

In the above configuration, the print head has been described to be divided into 16 blocks of 40 pixels (600 dpi) each. The print head may further be divided into a greater number of blocks as needed.

Although, in the above embodiments, printing has been described to be executed by dividing a print area in the paper feed direction into a plurality of areas, the dividing method for the divided printing is not limited to the above. For example, there is a method which involves masking a grid pattern over data to divide the data into two groups and printing the data in two printing scans. It is also possible to divide print data into a plurality of blocks by using a larger size of mask pattern and to form an image in two or more printing scans.

Other Embodiments

This invention may be applied either to a system made up of a plurality of devices (such as host computer, interface device, reader and printer) or to equipment made up of a single device (such as copying machine and facsimile)

Also included in the scope of this invention is a device which, to realize functions shown in the above embodiments, supplies software program codes to a computer in an apparatus or system connected to various devices so that the computer (CPU or MPU) operates various devices according to the loaded program.

In this case, the software program codes themselves realize the functions of the above embodiments and thus the program codes themselves and a means for supplying the program codes to the computer, e.g., a storage medium storing the program codes, constitute this invention.

Storage media to store such program codes may include floppy (registered trademark) disks, hard disks, optical disks, magnet-optical disks, CD-ROMs, magnetic tapes, nonvolatile memory cards, and ROMs.

It is obvious that the program codes are included in the embodiments of this invention not only when the functions of the above embodiments are implemented by computers executing the program codes supplied but also when the functions are realized by the program codes in cooperation with an operating system or other application software running on the computer.

Also included in this invention is an arrangement in which the supplied program codes are stored in a memory installed in a computer function extension board or in a function extension unit connected to the computer and in which a CPU provided in the function extension board or in the function extension unit executes a part or all of processing according to instructions from the program codes to realize the functions of the above embodiments.

As described above, when an image is printed which will cause a current in excess of a maximum capacity of a power supply to flow in a print head, this invention allows an optimum printing method to be selected from among a plurality of printing methods which differ in a printing scan speed and in the number of divisions for divided printing, thereby utilizing the power supply to its maximum capacity and keeping a throughput from deteriorating during the printing operation.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

This application claims priority from Japanese Patent Application No. 2004-156793 filed May 26, 2004, which is hereby incorporated by reference herein.

What is claimed is:

1. A printing apparatus for printing an image on a print medium by a print head having a plurality of printing elements arrayed in a predetermined direction, while scanning the print head over the print medium in a direction different from the predetermined direction, the printing apparatus comprising:

detection means for detecting a number of data indicating print for each of a plurality of blocks obtained by dividing a print area which is printable by the print head in one scan;

comparison means for comparing a value detected by the detection means with a plurality of thresholds; and decision means for determining, based on a result of the comparison made by the comparison means, a scan speed of the print head and a number of scans of the print head required to print the print area, wherein the decision means, (A) when the detected value is equal to or lower than a first threshold, determines a first scan speed as the scan speed and K (K is an integer equal to or greater than 1) as the number of scans, (B) when the detected value is higher than the first threshold and equal to or lower than a second threshold, determines a second scan speed which is slower than the first scan speed as the scan speed and K as the number of scans, and (C) when the detected value is higher than the second threshold, determines the second scan speed as the scan speed and an integer greater than K as the number of scans.

2. A printing apparatus according to claim 1, wherein K is 1.

3. A printing apparatus for printing an image on a print medium by a print head having a plurality of printing elements arrayed in a predetermined direction, while scanning the print head over the print medium in a direction different from the predetermined direction, the printing apparatus comprising:

detection means for detecting a number of data indicating print for each of a plurality of blocks obtained by dividing a print area which is printable by the print head in one scan;

comparison means for comparing a value detected by the detection means with a plurality of thresholds; and decision means for determining, based on a result of the comparison made by the comparison means, a scan speed of the print head and a number of scans of the print head required to print the print area, wherein the plurality of thresholds are matched in advance to different kinds of the print medium and to different print qualities, wherein the comparison means compares the detected value with the plurality of the thresholds matched to the different kinds of print medium and the different print qualities, and wherein the decision means determines, based on the result of comparison, the scan speed and the number of scans matched in advance to the different kinds of print medium and the different print qualities.

4. A printing apparatus for printing an image on a print medium by a print head having a plurality of printing elements arrayed in a predetermined direction, while scanning the print head over the print medium in a direction different from the predetermined direction, the printing apparatus comprising:

detection means for detecting a number of data indicating print for each of a plurality of blocks obtained by dividing a print area which is printable by the print head in one scan;

comparison means for comparing a value detected by the detection means with a plurality of thresholds; and decision means for determining, based on a result of the comparison made by the comparison means, a scan speed of the print head and a number of scans of the print head required to print the print area, wherein the decision means, (A) when the detected value is equal to or lower than a first threshold, determines a first scan speed as the scan speed and K (K is an integer equal to or greater than 1) as the number of scans, (B) when the detected value is higher than the first threshold and equal to or lower than a second threshold, determines a second scan speed which is slower than the first scan speed as the scan speed and K as the number of scans, and (C) when the detected value is higher than the second threshold, determines the first scan speed as the scan speed and an integer greater than K as the number of scans.

5. A printing apparatus for printing a plural color image on a print medium by ejecting a plurality of inks having different colors from a print head having a plurality of printing elements, while scanning the print head over the print medium in a direction different from an arrangement direction of the printing elements, the printing apparatus comprising:

detection means for detecting, for each of the color inks, a number of data indicating print for each of a plurality of blocks obtained by dividing a print area which is printable by the print head in one scan;

comparison means for comparing a total of values for respective color inks detected by the detection means with a plurality of thresholds; and decision means for determining, based on a result of the comparison made by the comparison means, a scan speed of the print head and a number of scans of the print head required to print the print area.

6. A printing apparatus according to claim 5, wherein the comparison means compares, with the plurality of thresholds, the total which is obtained by multiplying the detected value for respective color inks by a coefficient based on electric power required to operate the printing elements for respective color inks.

7. A printing apparatus according to claim 5, wherein the decision means, (A) when the detected value is equal to or lower than a first threshold, determines a first scan speed as the scan speed and K (an integer equal to or greater than 1) as the number of scans, (B) when the detected value is higher than the first threshold and equal to or lower than a second threshold, determines a second scan speed which is slower than the first scan speed as the scan speed and K as the number of scans, and (C) when the detected value is higher than the second threshold, determines the second scan speed as the scan speed and an integer greater than K as the number of scans.

8. A controlling method of a printing apparatus for printing an image on a print medium by a print head having a plurality of printing elements arrayed in a predetermined direction, while scanning the print head over the print medium in a direction different from the predetermined direction, comprising:

a detection step for detecting a number of data indicating print for each of a plurality of blocks obtained by dividing a print area which is printable by the print head in one printing scan;

a comparison step for comparing a value detected by the detection step with a plurality of thresholds; and a decision step for determining, based on a result of the comparison made by the comparison step, a scan speed of the print head and a number of scans of the print head required to print the print area, wherein, in the decision step, (A) when the detected value is equal to or lower than a first threshold, a first scan speed as the scan speed and K (K is an integer equal to or greater than 1) as the number of scans are determined, (B) when the detected value is higher than the first threshold and equal to or lower than a second threshold, a second scan speed which is slower than the first scan speed as the scan speed and K as the number of scans are determined, and (C) when the detected value is higher than the second threshold, the second scan speed as the scan speed and an integer greater than K as the number of scans are determined.

9. A computer program product comprising a program stored on a computer-readable medium, said program being capable of executing in a computer to perform information processing for a printing apparatus, the printing apparatus prints an image on a print medium by a print head having a plurality of printing elements arrayed in a predetermined direction, while scanning the print head over the print medium in a direction different from the predetermined direction, the computer program comprising:

a first program code for detecting a number of data indicating print for each of a plurality of blocks obtained by dividing a print area which is printable by the print head in one scan;

a second program code for comparing a detected value with a plurality of thresholds; and a third program code for determining, based on a result of the comparison, a scan speed of the print head and the number of scans of the print head required to print the print area, wherein the third program code, (A) when the detected value is equal to or lower than a first threshold, determines a first scan speed as the scan speed and K (K is an integer equal to or greater than 1) as the number of scans, (B) when the detected value is higher than the first threshold and equal to or lower than a second threshold, determines a second scan speed which is slower than the first scan speed as the scan speed and K as the number of scans, and (C) when the detected value is higher than the second threshold, determines the second scan speed as the scan speed and an integer greater than K as the number of scans.

10. A controlling method of a printing apparatus for printing an image on a print medium by a print head having a plurality of printing elements arrayed in a predetermined direction, while scanning the print head over the print medium in a direction different from the predetermined direction, comprising:

a detection step for detecting a number of data indicating print for each of a plurality of blocks obtained by dividing a print area which is printable by the print head in one scan;

a comparison step for comparing a value detected by the detection step with a plurality of thresholds; and a decision step for determining, based on a result of the comparison made by the comparison step, a scan speed of the print head and the number of scans of the print head required to print the print area, wherein, in the decision step, (A) when the detected value is equal to or lower than a first threshold, a first scan speed as the scan speed and K (K is an integer equal to or greater than 1) as the number of scans are determined, (B) when the detected value is higher than the first threshold and equal to or lower than a second threshold, a second scan speed which is slower than the first scan speed as the scan speed and K as the number of scans are determined, and (C) when the detected value is higher than the second threshold, the first scan speed as the scan speed and an integer greater than K as the number of scans are determined.

* * * * *

UNITED STATES PATENT AND TRADEMARK OFFICE

CERTIFICATE OF CORRECTION

PATENT NO. : 7,347,519 B2
APPLICATION NO. : 11/132191
DATED : March 25, 2008
INVENTOR(S) : Mitsutoshi Nagamura et al.

It is certified that error appears in the above-identified patent and that said Letters Patent is hereby corrected as shown below:

ON THE TITLE PAGE:

In item "(57) ABSTRACT," line 12, "CURRENT" should read -- current --.

COLUMN 5:

Line 34, "to the each" should read -- to each --.
Line 40, "above-mentioned." should read -- mentioned above. --.

COLUMN 6:

Line 44, "(the U.S." should read -- (U.S. --.

COLUMN 7:

Line 33, "I. A" should read -- 1. A --.

COLUMN 8:

Line 34, "corresponding a" should read -- corresponding to a --.

COLUMN 9:

Line 34, "plurality" should read -- plurality of --.
Line 44, "thresholds" should read -- thresholds, --.
Line 45, "treshold" should read -- threshold, --.
Line 62, "sprinting" should read -- printing --.

COLUMN 10:

Line 8, "a kind of a" should read -- a kind of --.
Line 18, "basing on" should read -- based on --.
Line 24, "register" should read -- a register --.
Line 62, "the case" should read -- in the case --.

UNITED STATES PATENT AND TRADEMARK OFFICE

CERTIFICATE OF CORRECTION

PATENT NO. : 7,347,519 B2
APPLICATION NO. : 11/132191
DATED : March 25, 2008
INVENTOR(S) : Mitsutoshi Nagamura et al.

It is certified that error appears in the above-identified patent and that said Letters Patent is hereby corrected as shown below:

COLUMN 11:

Line 14, “such this” should read -- such --.
Line 17, “each color dots” should read -- each of the color dots --.
Line 18, “the plurality block of each” should read -- each of the plurality of blocks --.

COLUMN 12:

Line 8, “times” should read -- factor --.

COLUMN 13:

Line 23, “facsimile)” should read -- facsimile). --.

Signed and Sealed this

Tenth Day of March, 2009

JOHN DOLL
*Acting Director of the United States Patent and Trademark Office*